United States Patent [19]

Esch et al.

[11] Patent Number: 4,698,953

[45] Date of Patent: Oct. 13, 1987

[54] BAG FILLING APPARATUS

[75] Inventors: Friedrich D. Esch, Andover; John G. Price, Bishop's Waltham, both of United Kingdom

[73] Assignee: AMF Incorporated, White Plains, N.Y.

[21] Appl. No.: 860,188

[22] PCT Filed: Jul. 11, 1985

[86] PCT No.: PCT/GB85/00310

§ 371 Date: Mar. 4, 1986

§ 102(e) Date: Mar. 4, 1986

[87] PCT Pub. No.: WO86/00597

PCT Pub. Date: Jan. 30, 1986

[30] Foreign Application Priority Data

| | | | |
|---|---|---|---|
| Jul. 12, 1984 | [GB] | United Kingdom | 8417813 |
| Aug. 2, 1984 | [GB] | United Kingdom | 8419705 |
| Nov. 15, 1984 | [GB] | United Kingdom | 8428908 |
| Nov. 15, 1984 | [GB] | United Kingdom | 8428909 |

[51] Int. Cl.[4] ..... B65B 43/26

[52] U.S. Cl. ..... 53/529; 53/202; 53/276

[58] Field of Search ..... 53/529, 438, 272, 278, 53/276, 530, 202; 141/237, 238

[56] References Cited

U.S. PATENT DOCUMENTS

| | | | |
|---|---|---|---|
| 2,667,997 | 2/1954 | Vogt | 53/202 X |
| 2,671,587 | 3/1954 | Vogt | 53/202 X |
| 3,903,674 | 9/1975 | Brush et al. | 53/571 X |
| 4,330,252 | 5/1982 | Bullock et al. | 53/529 X |
| 4,448,008 | 5/1984 | Pankratz et al. | 53/202 |

FOREIGN PATENT DOCUMENTS

| | | |
|---|---|---|
| 2558886 | 7/1977 | Fed. Rep. of Germany . |

*Primary Examiner*—James F. Coan

*Attorney, Agent, or Firm*—Willian Brinks Olds Hofer Gilson & Lione

[57] ABSTRACT

An apparatus for filling and handling bags with tobacco comprises (a) an intermittently rotatable turret having a plurality of stations for sequential indexing, (b) a pair of chambers at each station for receiving measured portions of tobacco to be packaged as each station is indexed at a delivery position, (c) a hopper for supplying the measured portions of tobacco to said chambers, (d) movable plates at each station for compressing the portions of tobacco within the chambers, (e) arms for receiving and clamping a pair of bags at each station as each station is indexed at a bag receiving position, and (f) chutes for discharging the compressed portions from the chambers into the bags in pairs as each station is indexed at a tobacco transfer position.

Each chamber is defined by a base plate and movable jaws disposed vertically and parallel to each other.

9 Claims, 6 Drawing Figures

BAG FILLING APPARATUS

BACKGROUND OF THE INVENTION

The present invention relates to a bag filling apparatus for a packaging machine and more particularly, but not solely, to an apparatus for filling and handling tobacco pouches.

STATEMENT OF PRIOR ART

In known tobacco pouch packaging machines speeds of about 60 packages per minute are achieved. Speeds above this become problematical especially in view of the difficulty of transferring measured portions of tobacco into pouches involving significant forces due to inertia or friction.

OBJECT OF THE INVENTION

It is an object of the invention to substantially increase the packaging speed to say in excess of 120 packages per minute.

SUMMARY OF THE INVENTION

According to the present invention there is provided an apparatus for filling and handling bags with material in strand or other particulate form comprising (a) an intermittently rotatable turret having a plurality of stations for sequential indexing, (b) a pair of chambers at each station for receiving measured portions of material to be packaged as each station is indexed at a material delivery position, each chamber being defined by (i) a base plate and (ii) movable jaws disposed vertically and parallel to each other, (c) means for supplying material in measured portions to said chambers, (d) means at each station for moving said jaws for compressing the portions of material within the chambers, (e) means for receiving and clamping a pair of bags at each station as each station is indexed at a bag receiving position, and (f) means for discharging the compressed portions from said chambers into said bags in pairs as each station is indexed at a material transfer position.

By effecting simultaneous filling of pairs of pouches on a single turret, the overall handling speed is doubled in comparison with known packaging machines.

BRIEF DESCRIPTION OF DRAWINGS

An embodiment of the present invention will now be described, by way of example, with reference to the accompanying drawings, wherein.

DESCRIPTION OF PREFERRED EMBODIMENT

Figure 1:
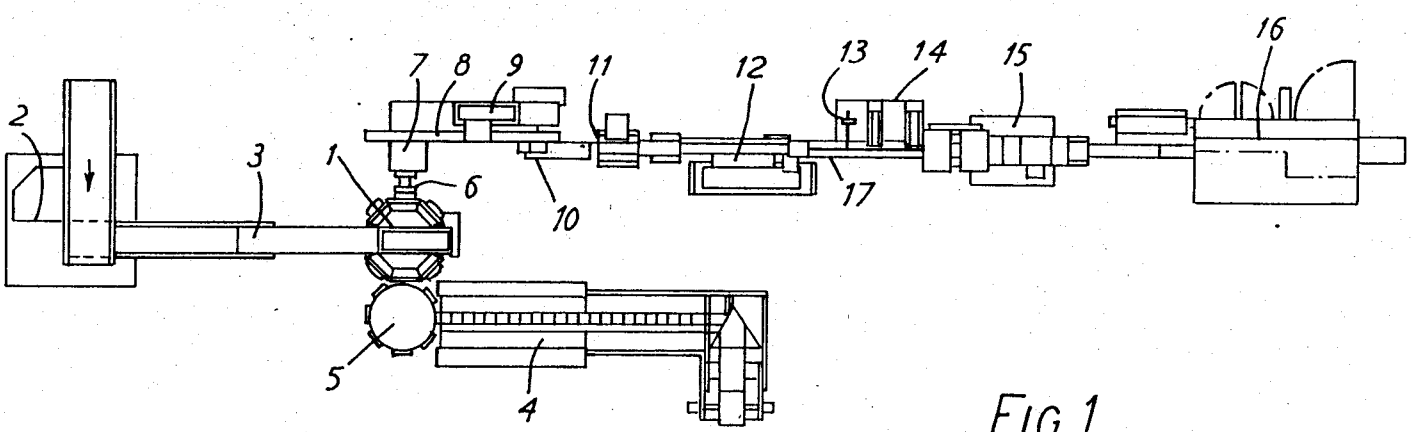
FIG. 1 shows a schematic view of a packaging machine.
Figure 2:
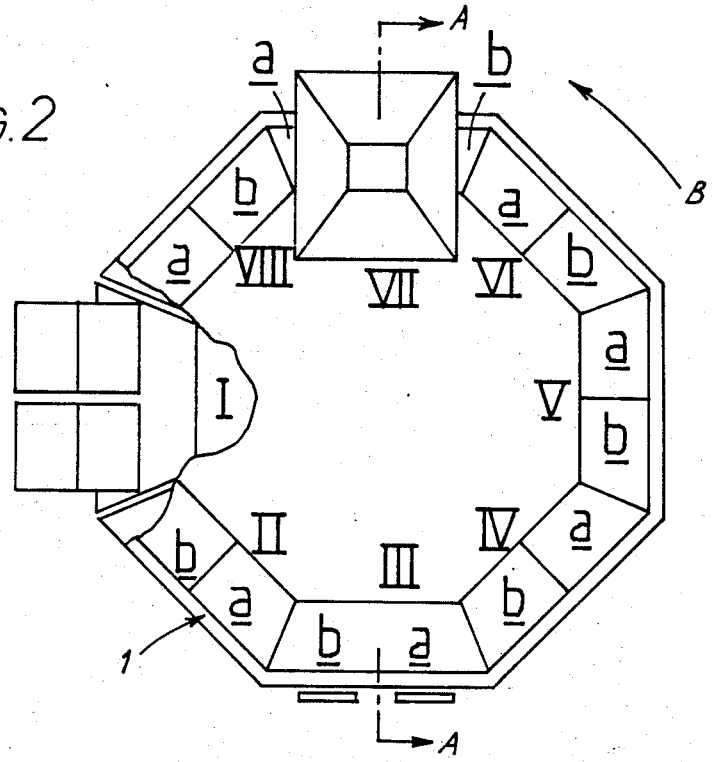
FIG. 2 shows a plan view of a filling turret according to the invention.
Figure 3:
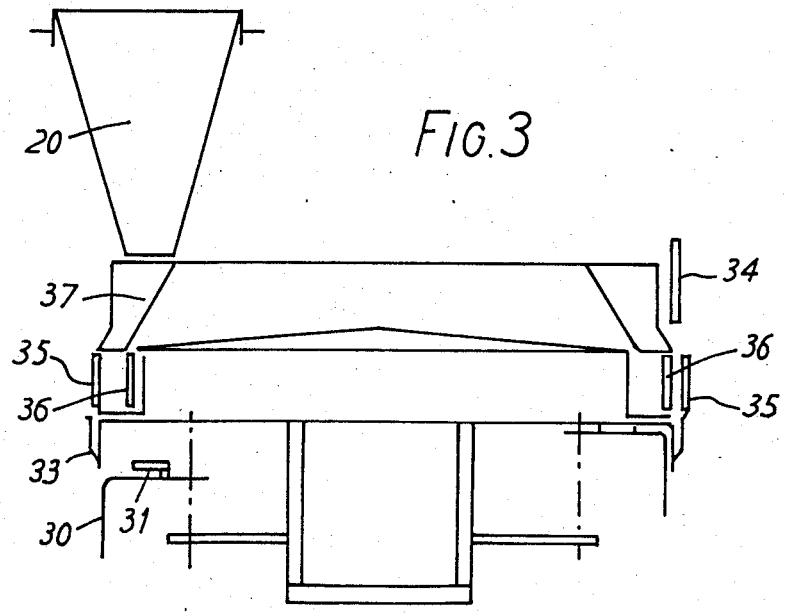
FIG. 3 shows a section along the line A—A of FIG. 2.
Figure 5:
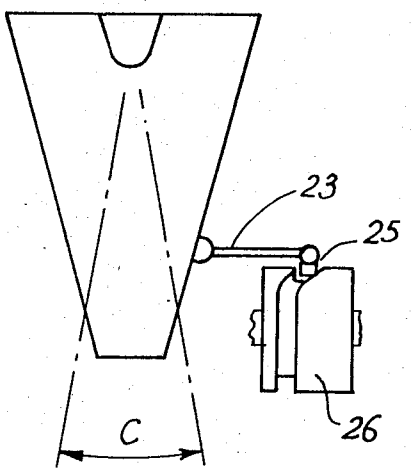
FIG. 5 shows a front view of the selector chute shown in FIG. 4.
Figure 4:
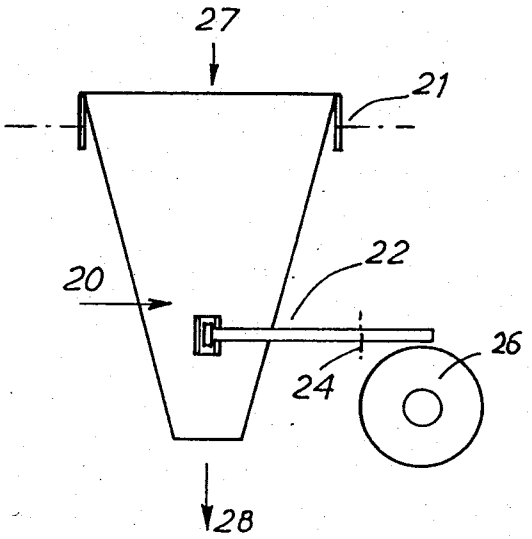
FIG. 4 shows a side elevation of a selector chute.

The tobacco packaging machine shown in plan in FIG. 1 is formed by a line of processing stations, which line comprises a pouch packer turret assembly 1 to which is supplied portions of weighted tobacco from a 25 g hand rolled tobacco (HRT) weigher 2 via a bucket conveyor 3 and empty pouches from a pouch maker 4 via a pouch transfer unit 5. After filling the pouches are taken from the turret assembly 1 by a take-off device 6 and transferred to a pouch folder 7. The folded pouches leaving the folder are deposited on a conveyor 8 which conveys the pouches to a labelling unit 9. The remainder of the packaging line includes a take-off conveyor 10, a check weigher 11, a buffer store 12, a doffer 13, a pouch replacement device 14, an over-wrapper 15 and a boxing unit 16.

Tobacco portions are weighed by the weigher 2 and fed to the turret 1 by means of the bucket conveyor 3. The pre-weighed portions of tobacco are diverted by means of a selector chute into hoppers attached to the top of the turret which indexes through a distance equivalent to two hoppers, the tobacco portions being fed into the selector chute from the bucket conveyor 3.

With reference to FIGS. 2 to 5 there is shown a selector chute 20 arranged above turret 1 which has pairs of stations a and b and is rotatable in the direction of arrow B into eight positions I, II, III, IV, V, VI, VII and VIII. At position I two pouches are transferred to the turret and clamped onto the turret. As the turret moves from position II to position III tobacco is compacted in filling chutes and both pouches are lifted up so that filling chutes enter pouches and at position III tobacco is pushed into the pouches. As the turret moves from position III to position IV the pouches are removed from the filling chutes and compaction rams in the filling chutes open. At position V the pouch clamps are released and the pouches are removed from the turret.

The selector chute 20 is provided with lugs 21 which are pivotably mounted. Pivotably mounted on chute 20 is a link arm 22 which carries, at its end remote from the chute 20, a link arm 23. The link arm is pivotably mounted between its ends at 24. The link arm 23 carries, at its end remote from link arm 22, a cam follower 25 which runs in a groove of a cam 26. The groove is cut and the cam 26 operated so as to move the chute 20 synchronously with the turret at a given rotational speed. This enables the tobacco which enters the chute at 27 to be ejected from the chute at 28.

When the turret is stationary the selector chute 20 is arranged to enable a portion of tobacco to be dropped into a hopper at station b at position VII. On rotation of the turret to its to its next indexing position the hopper at station b of position VII moves to station b at position VIII. During the first half of this movement the chute 20 swings about arc C and deposits a tobacco portion into station b during motion. During the second half of the indexing movement the selector chute is stationary while the hopper at station a at position VI moves to station a at position VII. A portion of tobacco is then deposited by chute 20 in the hopper at station a at position VII before the chute 20 swings back about arc C to be arranged to enable a portion of tobacco to be dropped into a hopper at station b at position VII and to commence the cycle again.

This sequence maximises the time available in which to deposit tobacco portions in the hoppers.

During a one-second chute cycle divided into 24 increments, the chute is stationary and fills a hopper at station b from increments 0 to 5, indexing takes place and the chute moves with the turret from increments 5 to 9, there is a dwell from increments 9 to 13, the chute is stationary and fills a hopper at station a during increments 13 to 22, and the chute swings back from station a to station b during increments 22 to 24.

Figure 6:
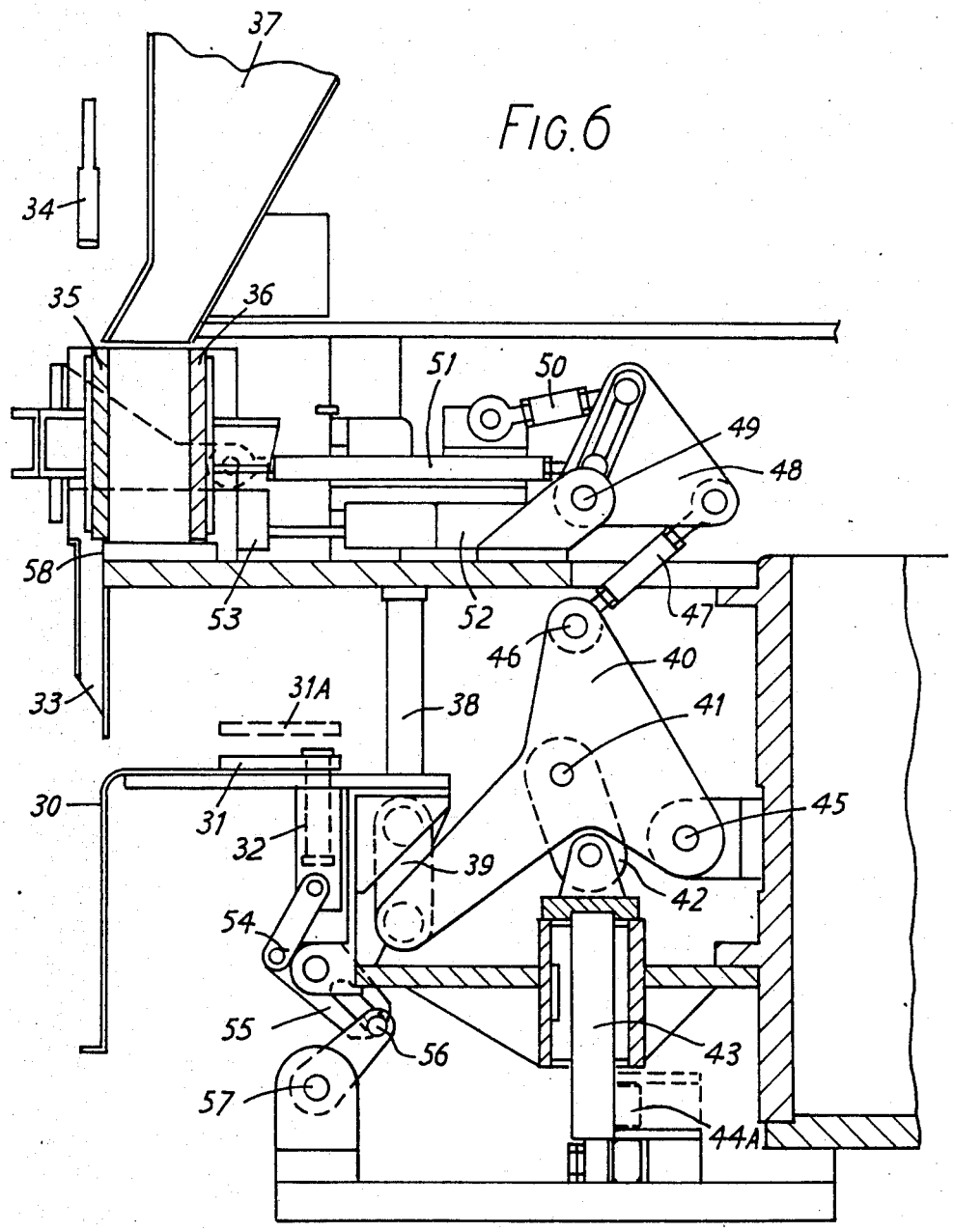
FIG. 6 shows a section through one of eight faces of a turret.

The arrangement for attaching tobacco pouches to the turret 1, pre-compacting tobacco and inserting tobacco into pouches will now be described with reference to FIG. 6. In order to achieve a greater rate of filling pouches, an eight sided turret is used, each side having a mechanism to fill two pouches.

Each face of the turret includes a pouch support platform 30 and a clamp 31 having a jaw urged towards the platform 30 by a compression spring 32. Above the platform 30 there is arranged a tobacco chute 33 beneath a ram 34. Above the chute 33 there are also arranged compacting jaws 35 and 36 beneath hoppers 37. In the open position of the jaws 35, 36 as shown in FIG. 6 the jaws define together with a base plate 58 on the turret a compression compartment for receiving and retaining the tobacco portion during compression.

The platform 30 is slidably mounted on a rod 38 and has a link arm 39 pivotably connected thereto. The end of the link arm 39 remote from the table is pivotably connected to one corner of a three-cornered pivot lift plate 40 pivoted about pivot 45. One end of a link arm 42 is connected to the pivot 41 and the other end of the link arm 42 is pivotably connected to a lug on a guide rod 43 having a cam follower 44.

A second corner of the plate 40 is pivotably mounted on a pivot 45 and to the third corner there is pivotably connected, at pivot 46, a tie rod 47. The end of the tie rod 47 remote from the plate 40 is pivotably connected to a triangular plate 48 which is pivoted on a pivot 49 and to which there are pivotably connected tie rods 50 and 51 which are connected to slideways 52 and 53 attached to the jaws 35 and 36.

Beneath the clamp 31 there is provided a Geneva link 54 and 55 connected to a rod 56 rotatable about a pin 57.

During an index from one position to another cam follower 44 is lifted to position 44A shown in chain-dotted lines. The rod 56 moves the Geneva link 54, 55 to urge the clamp 31 to its open position 31A shown in chain-dotted lines. When a pouch has been inserted between the clamp jaw and the pouch support platform 30 the reverse process occurs to allow the spring to urge the clamp 31 towards the platform 30 and clamp the pouch between platform 30 and the clamp jaw.

As cam follower 44 is lifted to its position 44A the lift plate 40 is raised and pivoted. By means of the interconnecting parts described the compacting jaws 35 and 36 will compress a tobacco portion therebetween and move the compressed portion to a position above the chute 33 clear of the base plate 58 until pivot 46 is vertically above pivot 45. At the same time the platform 30 slides vertically up rod 38 so that the chute 33 enters a pouch. Overtravel of the pivot 46 beyond top dead centre results in the jaws 35 and 36 opening slightly to reduce adhesion and/or friction between tobacco and jaws as the ram 34 pushes the tobacco into the pouch.

The arrangement therefore allows clamping a tobacco pouch on a platform which moves in a vertical direction, pre-compacting tobacco before insertion into a pouch and/or pre-compacting but with the compacting jaws opening slightly prior to the tobacco being transferred in order to minimize adhesion between jaws and tobacco.

We claim:

1. Apparatus for filling and handling bags with material in strand or other particulate form comprising (a) an intermittently rotatable turret having a plurality of stations for sequential indexing, (b) a pair of chambers at each station for receiving measured portions of material to be packaged as each station is indexed at a material delivery position, each chamber being defined by (i) a base plate and (ii) moveable jaws disposed vertically and parallel to each other (c) means for supplying material in measured portions to said chambers, (d) means at each station for moving said jaws for compressing the portions of material within the chambers, (e) means for receiving and clamping a pair of bags at each station as each station is indexed at a bag receiving position, and (f) means for discharging the compressed portions from said chambers into said bags in pairs as each station is indexed at a material transfer position.

2. A machine as claimed in claim 1, wherein said means for discharging are provided at the material transfer position comprise a pair of rams which can pass through the chambers at each station as each station arrives and is indexed at said material transfer position to insert the portions in the pouches.

3. Apparatus according to claim 1 ,wherein hoppers are disposed over each compression chamber through which measured portions of material are fed to the chambers.

4. Apparatus according to claim 1, including slideways on the turret at each station to which said jaws are connected, a pivotable plate connected by tie rods to said slideways, and means for oscillating said plate at the turret rotates, said tie rods being pivoted on said plate at positions which cause said jaws to move over different stroke lengths.

5. Apparatus according to claim 1, wherein the means for receiving and clamping the bags comprise a horizontal platform having a clamp thereon which is movable vertically towards and away from the platform between bag clamping and release positions, and means for raising and lowering said clamp as the turret rotates.

6. Apparatus according to claim 5, wherein the platform together with the clamp are movable vertically between a portion receiving position and a raised bag filling position.

7. Apparatus according to claim 6, wherein a vertically disposed chute is provided adjacent each chamber, said chute serving to enter a bag on upward movement of the platform and clamp, whereby a portion of compressed material is movable by the discharging means from the chamber into the bag held by the platform and clamp, said discharging means passing through the chamber and the chute during the discharging operation.

8. Apparatus according to claim 3, wherein a selector chute is pivotally mounted on a fixed portion of the apparatus and is disposed above the turret at the material delivery position, said selector chute serving to deliver sequentially arriving measured portions to adjacent chambers, drive means being provided to pivot the selector chute as a portion is being delivered to one chamber as the turret undergoes rotary movement and for holding the selector chute stationary over an adjacent chamber as the next portion is delivered.

9. Apparatus according to claim 8, wherein said drive means comprises a link pivotally attached at one end to the selector chute and has a follower at the other end engaging a cam groove in a cylinder rotatable synchronously with the turret.

* * * * *